United States Patent [19]

Flanagan et al.

[11] 3,948,697

[45] Apr. 6, 1976

[54] GUM PROPELLANT GRAINS WITH INHIBITOR COATING

[75] Inventors: Joseph E. Flanagan, Woodland Hills; George A. Lo, Canoga Park; Milton B. Frankel, Tarzana; Vernon E. Haury, Simi, all of Calif.

[73] Assignee: Rockwell International Corporation, El Segundo, Calif.

[22] Filed: July 11, 1973

[21] Appl. No.: 378,094

Related U.S. Application Data

[63] Continuation-in-part of Ser. No. 189,588, Oct. 15, 1971, abandoned.

[52] U.S. Cl. ..... 149/11; 149/14; 149/19.8; 149/92; 149/99; 149/100; 149/107; 102/103

[51] Int. Cl.[2] ..... C06B 45/22

[58] Field of Search ..... 149/4, 6, 19.8, 100, 11, 149/92, 107, 14, 99; 102/103

[56] References Cited

UNITED STATES PATENTS

| | | | |
|---|---|---|---|
| 3,677,010 | 7/1972 | Fink et al. | 102/103 X |
| 3,714,047 | 1/1973 | Marion et al. | 102/103 X |

*Primary Examiner*—Stephen J. Lechert, Jr.
*Attorney, Agent, or Firm*—L. Lee Humphries; Robert M. Sperry

[57] ABSTRACT

Propellant inhibitors are provided for cellulose-containing particulate solid propellants, and particularly for nitrocellulose-containing gun propellants, in which the inhibitor is the reaction product of a polyfunctional isocyanate such as polymethylene polyphenyl isocyanate and a polyol such as polyethylene glycol.

8 Claims, No Drawings

GUM PROPELLANT GRAINS WITH INHIBITOR COATING

The invention herein described was made in the course of or under a contract with the Department of the Air Force.

This is a continuation-in-part to application Ser. No. 189,588, filed Oct. 15, 1971, now abandoned.

BACKGROUND OF THE INVENTION

This invention relates to propellants and particularly to "gun propellants" which are generically defined herein as particulate solid propellants for propelling projectiles. Specifically, this invention is concerned with inhibitors for gun propellants in which the inhibitor is the reaction product of a polyfunctional isocyanate and a polyol. Suitable propellants are those containing an energetic or non-energetic cellulose binder.

At the outset, a clear distinction should be drawn between "solid propellants," as used in rocket engines, and "gun propellants," which are used to propel the projectiles of pistols, rifles, artillery pieces, and other types of guns. One major distinction can be found in configuration. The term "solid propellant," as used in rocket engines, refers to a single, cohesive grain which fills and is bonded to the case of the rocket engine. These solid propellant grains may be monolithic, in which instance they are intended as "end burning" grains; or may be generally cylindrical and formed with a single opening extending axially therethrough which may be star-shaped or otherwise configured in cross-section, in which instance they are intended as "internal burning" grains. In either instance, the solid propellants will have diameters of several inches to several feet, and lengths ranging from one foot to greater than 50 feet. In contrast, the term "gun propellant" refers to a plurality of particulate grains which are loosely contained within a metal case or cloth bag. For small arms, the individual grains of a gun propellant are cylindrical, but have diameters of only a few hundredths of an inch. For larger guns, such as artillery pieces, the individual grains may have diameters up to about one-half inch and lengths up to about 2 inches.

Another significant distinction between solid propellants and gun propellants is found in their reaction times. Solid propellants are intended to burn only on a single surface at substantially uniform rates for intervals of several seconds to several minutes at uniform pressures of the order of 1000 psi. In contrast, gun propellants are intended to burn completely in less time than is required for the bullet or other projectile to reach the end of the gun barrel, usually only a few milliseconds. In reality, the gun propellants provide a substantially instantaneous explosion, creating pressures of the order of 50,000 to 60,000 psi, which are contained by the chamber of the gun. This requires that the chamber portion of guns be constructed heavily and massively in order to contain these explosions. With prior art gun propellants, some effort has been made to control or limit the burning rate in order to cause the energy of the propellant to be expended over the entire interval while the projectile is travelling through the barrel of the gun. By doing this, the chamber pressures are significantly reduced which permits the guns to be produced more economically and to have increased service life. Furthermore, this controlled burning of the gun propellant provides improved pressure distribution during the propulsion of the projectile which serves to improve the piezometric efficiency and thus increase the muzzle velocity provided by a given gun propellant.

For any given gun propellant system, interior ballistic theory can be utilized to define an optimum pressure-time profile and consequently a velocity-time profile. This most desirable profile is one in which relatively high velocities are attained at moderately low peak chamber pressures.

It has also been proposed heretofore to control the burning rate of gun propellants by the use of "deterrent" materials which serve to retard the burning rate of the grain material and are applied by impregnating the deterrent into the surface of the grain. However, when this is done, the depth of the impregnation cannot be accurately controlled. Consequently, the effect of the deterrent varies from grain to grain. Moreover, the deterrents serve to actually reduce the burning temperature of the gun propellant and, hence, compromise the performance.

In contrast, in accordance with the present invention, it is proposed to coat the gun propellant grains with an inhibitor material which bonds to, but does not impregnate the grain. Inhibitors are essentially inert chemicals which do not burn in the reaction time of gun propellants and which are applied only to the surfaces of the propellant grain where it is desired to prohibit burning. This causes the grains to burn progressively, but does not affect the burning characteristics of the grain. Inhibitors can be applied by bonding sheets of inhibitor material to the surfaces to be restricted, by wrapping the grain with selected tapes, by dipping the grain into the desired inhibitor, or by spraying the inhibitor coating onto the surface of the grain during extrusion, or the like.

The primary requirement for the inhibitor is that it must possess excellent bonding characteristics and adequate thermal resistance in order to survive the complete ballistic cycle. An additional requirement is that total curing occurs. If only partial curing occurs, the inhibited surface from one grain may adhere to the uninhibited surface of an adjacent grain, thereby further reducing the burning surface. Prediction of the instantaneous burning surface would not be possible under these circumstances, and the desired pressure-velocity-time curves would not be obtainable on a repetitive basis. The complexity of the problems that would occur if uncured inhibitor is present would be magnified many times over, since a very large number of propellant grains are typically packed into each cartridge.

Accurate control of the inhibitor thickness must be accomplished regardless of the method employed for deposition. The amount of tolerable performance degradation due to the volume occupied by the inert inhibitor will vary depending upon the individual grain dimensions; however, loss of no more than 1 to 2 percent in the variable energy is a desirable upper limit.

SUMMARY OF THE INVENTION

Accordingly, an object of this invention is to provide an effective inhibitor for gun propellants and particularly for particulate gun propellants for propelling projectiles.

A further object of the invention is to provide an inhibitor for gun propellant applications which has the capability to maintain its thermal and structural integrity during the course of a ballistic cycle.

It has now been discovered that improved gun propellant inhibitors can be prepared from polyfunctional isocyanates and polyols. For example, a gun propellant inhibitor prepared from polymethylene polyphenyl isocyanate, an aromatic polyfunctional isocyanate, and polyethylene glycol, an $\alpha,\omega$-diol, has been used to coat gun propellants with a 1 to 150 micron thickness. This inhibitor has been applied to the gun propellant surface by several methods and requires only about one minute cure time. Combustion studies have shown that the inhibitor will maintain its integrity during the course of the ballistic cycle.

DESCRIPTION OF THE PREFERRED EMBODIMENTS

The present inhibitors were developed for use with gun propellant compositions containing energetic or non-energetic cellulose binders. Good inhibitors must meet several criteria: (1) compatibility with the gun propellant composition; (2) good adhesion; (3) adequate mechanical properties; (4) susceptibility to easy application; and (5) formation of a non-tacky final surface. The present inhibitors meet these criteria and function by cross-linking a polyol, particularly a hydroxy-terminated prepolymer such as polyethylene glycol, to the residual hydroxy groups in the cellulose binder of the propellant via a multifunctional isocyanate.

The polyfunctional isocyanate is preferably a polyfunctional aromatic isocyanate such as polymethylene polyphenyl isocyanate (PAPI). Illustrative of other useful polyfunctional aromatic isocyanates are triphenylmethane triisocyanate and toluene diisocyanate. However, polyfunctional aliphatic or alicyclic isocyanates such as hexamethylene diisocyanate, lysine diisocyanate, and isophorone diisocyanate can be used.

The polyol component of the inhibitor may be either an aliphatic or an aromatic polyol. The polyol is desirably an aliphatic polyol and particularly an aliphatic $\alpha,\omega$-diol such as an hydroxy-terminated polyether, polyester, or polybutadiene. The preferred class of polyols is the hydroxy-terminated polyethers and particularly the polyalkylene glycols such as polyethylene glycol and polypropylene glycol.

Conventional catalysts for the urethane reaction are employed to accelerate curing. The particular catalyst chosen will depend on the polyfunctional isocyanate-polyol system selected, as is well known in the art. Illustrative catalysts are cupric acetonylacetonate, ferric acetonylacetonate, and dibutyl tin dilaurate. It is preferred to apply the inhibitor by dissolving the inhibitor ingredients in a suitable solvent and applying the ingredients to the grain surface by coating, painting, spraying, or the like.

The inhibitor of the present invention forms a strong bond to the cellulose-based propellant. Scraping with a razor blade or sharp knife only slightly scars the surface and the inhibitor cannot be removed without some propellant fragments being bonded to the inhibitor fragments. Scanning electron microscope pictures at 500X have been taken of a typical sample of inhibited (5-microns) propellant. The inhibited propellant surface was vigorously scratched with a knife blade and the boundaries of these scratches were photographed. It was observed that the inhibitor was still attached to the fragments of disrupted propellant. Additionally, an inhibited propellant surface has been sliced under a microscope in order to obtain a "clean" cut. Examination of the cut showed that the bonding function of the inhibitor to the propellant is indistinguishable due to the excellent bonding characteristics.

The preferred polyfunctional isocyanate is PAPI. Polyethylene glycol (PEG) has been found to be the best polyol for use in conjunction with PAPI. The polyol should be liquid or at least of sufficiently low molecular weight to be soluble so that the inhibitor can be applied to the propellant surface by conventional technique. For example, it is generally preferred that the molecular weight of the polyethylene glycol component not exceed about 600 and, if polypropylene glycol is used, that the molecular weight of this component not exceed about 4000. The preferred catalyst for the PAPI/PEG system is dibutyl tin dilaurate (DBTD). This inhibitor system is the one which has been most extensively studied and will be used to demonstrate the invention throughout the remainder of the specification. It should be understood, however, that this inhibitor system is merely illustrative of the broader polyfunctional isocyanate/polyol inhibitor system.

When the NCO/OH ratio in this preferred inhibitor system is maintained between 1.0 and 1.4 and the dibutyl tin dilaurate level kept between 0.4 and 0.8 weight percent, excellent curing has been found to occur in one minute at 110° to 130°F. Methylene dichloride ($CH_2Cl_2$) is the solvent of choice for applying the preferred inhibitor system. Control of the inhibitor thickness is accomplished by varying the amount of methylene dichloride present. For example, for a 25-micron coating approximately six parts of solvent are used for each four parts of inhibitor. Reduction of the inhibitor thickness is accomplished by increasing the solvent content. Doubling the solvent content reduces the inhibitor thickness approximately 50 percent.

To illustrate the invention, tests were run on several inhibited propellants in a high pressure window bomb. The propellant grains were 0.25 inch in width, 0.05 inch thick, and about 2 to 2.5 inches in length. One side of the propellant grain was coated with inhibitor. Ignition was accomplished by a hot nichrome wire pressed against one end of the grain. An initial series of tests were run on two propellant formulations, the first (No. 1) containing, by weight, 69 percent nitrocellulose, 30 percent cyclotetramethylene tetranitramine (HMX), and 1 percent dinitrodiphenylamine (NDPA); and the second (No. 2) containing, by weight, 54 percent nitrocellulose (13.1% N), 30% HMX, 10% dinitrotoluene (DNT), 5% PEG of molecular weight 400, and 1% NDPA. The inhibitor was a PAPI/PEG/DBTD composition. Coatings were applied in the range of 15 to 150 microns and bomb pressures of 500 and 1000 psi were used. All the samples burned smoothly with complete flame spreading on all surfaces except the inhibited surface.

Additional tests were carried out with the second propellant formulation (No. 2) above in which the inhibitor contained, by weight, 63.2% PAPI, 36.1% PEG, and 0.7% DBTD. Four samples of the inhibited propellant were burned at 3000 psi. The inhibitor thickness was 5, 10, 20, and 30 microns. All four samples showed excellent inhibition but a small amount of residue formation began to appear in the 20 and 30 micron cases.

Additional tests were conducted on standard M-10 propellant [by weight about 97% nitrocellulose (13.15% N), diphenylamine, 0.1% graphite, 1.5% ethyl alcohol, and 0.5% water] in which a 10 micron coating of the above defined inhibitor was applied. In addition, uninhibited M-10 samples were also burned. The tests were carried out at 4000 psi and excellent inhibition was observed with the inhibited propellant. The uninhibited samples were consumed in a rapid "fire-ball" manner.

Further verification of the effectiveness of the present inhibitor was made by firings in a small volume (2.0 cubic inch) impetus bomb. Thin strips of propellant (0.02–0.03 inch) were coated with inhibitor and small discs (0.34 –0.35 inch diameter) were cut out of the strips. Hot-wire ignition was utilized so that no correction was necessary for the igniter. The results of these tests are summarized in the table below:

TABLE

| Propellant Formulation | Charge Weight (grams) | Inhibitor Thickness, microns | $P_{max.}$ (psi) | $\infty^a$ |
|---|---|---|---|---|
| No. 2 | 2.815 | 20 | 12,800 | 1.60 |
| No. 2 | 2.045 | 20 | 9,600 | 1.74 |
| No. 2 | 2.540 | 1–2 | 11,100 | 1.13 |
| M-10 | 2.541 | 5 | 9,300 | 1.75 |

[a]Ratio of time to maximum pressure for inhibited versus uninhibited propellant.

Virtually the same maximum pressure was obtained for equal weights of inhibited and uninhibited propellant. For inhibitor coatings of 5 microns or more, the effectiveness of the inhibitor is 70 percent or higher. This is extremely good considering the long rise times incurred in the closed bomb tests since the inhibitor had to sustain itself against an impinging flame for a time period much longer than that typically incurred in an actual ballistic cycle. The one case where an extremely thin coating (1–2 microns) was applied illustrates that the inhibitor still exhibited a slight effect, although it is far from the otpimum results.

The above description is for the purpose of illustration and clarification only and it is intended that the scope of the invention not be limited except by reference to the appended claims.

We claim:

1. A gun propellant consisting of a plurality of inhibited, particulate, grains; each of said grains consisting of:

a fuel, an oxidizer, a cellulose binder, and an inhibitor coating secured to the exterior surface of said grain and consisting of the reaction product of a polyfunctional isocyanate and a polyol--.

2. The inhibited, particulate, gun propellant of claim 1 in which the polyfunctional isocyanate is a polyfunctional aromatic isocyanate.

3. The inhibited, particulate, gun propellant of claim 2 in which the polyfunctional aromatic isocyanate is polymethylene polyphenyl isocyanate.

4. The inhibited, particulate, gun propellant of claim 1 in which the polyol is a polyalkylene glycol.

5. The inhibited, particulate, gun propellant of claim 4 in which the polyalkylene glycol is polyethylene glycol or polypropylene glycol.

6. The inhibited, particulate, gun propellant of claim 1 in which the propellant contains a nitrocellulose binder and has an inhibitor coating thereon, said inhibitor being the reaction product of a polyfunctional aromatic isocyanate and a polyalkylene glycol.

7. The inhibited, particulate, gun propellant of claim 6 in which the polyfunctional aromatic isocyanate is polymethylene polyphenyl isocyanate and the polyalkylene glycol is polyethylene glycol or polypropylene glycol.

8. The inhibited, particulate, gun propellant composition of claim 6 in which the thickness of the inhibitor coating is between 1 and 150 microns.

* * * * *

UNITED STATES PATENT OFFICE

CERTIFICATE OF CORRECTION

PATENT NO. 3,948,697

DATED Apr. 6, 1976

INVENTOR(S) Joseph E. Flanagan et al

It is certified that error appears in the above-identified patent and that said Letters Patent are hereby corrected as shown below:

Cover page [54] in the title delete "Gum" and insert --Gun--.
Column 1, line 1, delete "Gum" and insert --Gun--.
Column 4, line 68, after "(13.15%N)," insert --1%--.

Signed and Sealed this

Tenth Day of August 1976

[SEAL]

*Attest:*

RUTH C. MASON
*Attesting Officer*

C. MARSHALL DANN
*Commissioner of Patents and Trademarks*